US007672613B2

(12) United States Patent
Shin

(10) Patent No.: US 7,672,613 B2
(45) Date of Patent: Mar. 2, 2010

(54) PHOTOSENSITIVE MATERIAL DRUM AND IMAGE-FORMING MACHINE EQUIPPED WITH THE PHOTOSENSITIVE MATERIAL DRUM

(75) Inventor: Koji Shin, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 336 days.

(21) Appl. No.: 11/790,563

(22) Filed: Apr. 26, 2007

(65) Prior Publication Data

US 2007/0253734 A1 Nov. 1, 2007

(30) Foreign Application Priority Data

Apr. 28, 2006 (JP) ..... 2006-124742

(51) Int. Cl.
*G03G 15/00* (2006.01)

(52) U.S. Cl. ..... 399/159

(58) Field of Classification Search ..... 399/90, 399/116, 117, 159
See application file for complete search history.

(56) References Cited

U.S. PATENT DOCUMENTS 7,020,410 B2 * 3/2006 Zogg et al. ..... 399/90

FOREIGN PATENT DOCUMENTS

JP 8-297434 11/1996

* cited by examiner

*Primary Examiner*—Hoang Ngo
(74) *Attorney, Agent, or Firm*—Smith, Gambrell & Russell, LLP

(57) ABSTRACT

A photosensitive material drum capable of easily preventing the leakage of the adhesive through the notches which are for confirming the earthing of the flange member. The flange member inserted in an end portion of the drum body includes an annular protuberance covering an end surface of the drum body, and an insertion drum portion forming protruded portions so as to come in contact with the inner peripheral surface of the drum body and recessed portions maintaining a gap relative to the inner peripheral surface of the drum body alternately along the inner peripheral surface of the drum body. An adhesive is applied onto the inner peripheral surface of the drum body facing the recessed portions to prevent the turn of the flange member. Notches are formed in the annular protuberance for exposing the end surface of the drum body, the notches being formed at positions neighboring the protruded portions.

8 Claims, 10 Drawing Sheets

PHOTOSENSITIVE MATERIAL DRUM AND IMAGE-FORMING MACHINE EQUIPPED WITH THE PHOTOSENSITIVE MATERIAL DRUM

BACKGROUND OF THE INVENTION

1. Field of the Invention

The present invention relates to a photosensitive material drum which uses an adhesive to prevent the turn between a drum body and a flange member forcibly inserted in an end portion of the drum body, and to an image-forming machine equipped with the photosensitive material drum.

2. Description of the Related Art

In an image-forming machine such as a copier or a laser printer, in general, the surface of a photosensitive material drum is uniformly electrically charged, is exposed to image-bearing light, and the electric charge is decreased in the portions corresponding to the portions exposed to light to thereby form an electrostatic latent image. A toner is fed from a developer to the electrostatic latent image to form a toner image so as to be visualized. The toner image formed on the photosensitive material drum is transferred onto a paper by using transfer means, and the paper onto which the toner image is transferred is passed through a fixing unit to fix the toner to thereby form an image. Therefore, the photosensitive material drum plays an important role in forming the image.

FIG. 8 illustrates an end portion of a photosensitive material drum of the related art.

The photosensitive material drum 51 comprises a cylindrical drum body 52, and includes an annular flange member 53 fitted into the inner peripheral surface of the drum body 52, and a bearing 54 fitted to the inside of the flange member 53. A flat earth plate 55 (see earth plate 105 in FIG. 3) is attached to the outer peripheral portion of the bearing 54 on the inner surface side of the flange member 53, and pawls 55a at the ends on the outer side of the earth plate 55 are brought into contact with the inner peripheral surface of the drum body 52.

Referring to FIG. 9, the flange member 53 is provided with a drum portion 57 and an annular protuberance 56 positioned on the outer surface side of the photosensitive material drum 51 (see FIG. 8). The drum portion 57 has protruded portions 58 and recessed portions 59 which are alternately formed in the circumferential direction thereof, and the annular protuberance 56 is forming a plurality of notches 63 therein. The portions forming the notches 63 are positioned neighboring the recessed portions 59.

In fixing the flange member 53 to the drum body 52, the drum member 52 is, in many cases, used with the flange member 53 being lightly fitted into the drum member 52 to avoid a change in the size of the drum body 52. This is because from the standpoint of space of the image-forming machine, gap pulleys such as a developing roller, a transfer roller and a charging roller are, in many cases, disposed near the portion where the flange member is forcibly inserted in the drum body 52 forming gaps relative to the drum body 52. Here, a change in the size of the drum body 52 adversely affects the image that is formed. In a state where the flange member is lightly inserted, however, the drum body 52 and the flange member 53 easily undergo the slipping relative to each other. In the image-forming machine disclosed in JP-A-8-297434, as shown in FIG. 10, an adhesive is applied onto a flange member 72 so as to adhere the flange member 72 to a drum body 71. In more detail, elastic sheets 73 are fixed to a periphery surface of the flange member 72 and the adhesive is applied to the area of the surface, where the sheets 73 are not fixed.

OBJECT AND SUMMARY OF THE INVENTION

In the photosensitive material drum 51 shown in FIGS. 8 and 9, a defective image is formed if the electric charge is not sufficiently removed from the photosensitive material layer before forming an electrostatic latent image. Therefore, the photosensitive material drum 51 is provided with earthing means for flowing the electric charge of the photosensitive material to the frame side of the image-forming machine via a drum shaft 62.

The earthing is accomplished by bringing the earth plate 55 fitted to the flange member 53 at the end of the drum body 52 into slide contact with the drum shaft 62 or the bearing 54 thereof. The earth plate 55 rotates together with the drum body 52 and the flange member 53 relative to the drum shaft 62, and has pawls (see pawls 122 in FIG. 3) at its outer peripheral portions that come in pressed contact with the inner peripheral surface 60 of the drum body 52. That is, the flange member 53 to which the earth plate 55 is attached is pushed into the drum body 52 from an end of the drum body 52. Here, as the pawls of the earth plate 55 push the inner peripheral surface 60 of the drum body 52, the earth plate 55 electrically connects the drum body 52 to the frame side of the image-forming machine on the earthing side, whereby the electric charge of the photosensitive material flows out to form an electrostatic latent image. For forming the image, therefore, it is therefore important that the drum body 52 is reliably earthed.

In the production line, on the other hand, if the drum body 52 is reliably earthed is confirmed by forming notches 63 in the flange member 53 for confirming the earthing, enabling the end surface 64 of the drum body 52 to be partly exposed, and by inspecting the conduction between the end surface 64 and the earthing portion on the frame side. The end surface 64 of the drum body 52 is used for inspecting the conduction because of the following reason. That is, in the case of the amorphous silicon (A-Si) type drum body 52, the silicon layer is deposited over the full length of the drum body 52 due to the method of production, and there is left no portion for confirming the earthing on the outer peripheral surface of the drum body 52.

At the time of forcibly inserting the flange member 72 into the drum body 71, as shown in FIG. 10, it is necessary to apply the adhesive thickly to the periphery surface of the flange member 72. Further, it is troublesome to applying the adhesive to the area of the periphery surface of the flange member 72, where the sheets 73 are not fixed. On the other hand, if the adhesive is applied onto the recessed portions 59 as shown in FIGS. 8 and 9, the recessed portions 59 are communicated with the notches 63, and so the adhesive leaks outward through the notches 63. Accordingly, a strict control is required for a step of applying the adhesive in proper amounts.

The present invention was accomplished in view of the above circumstances and has an object of providing a photosensitive material drum which makes it easy to prevent the leakage of the adhesive through the notches in the flange member which are for confirming the earthing, and an image-forming machine equipped with the above photosensitive material drum.

In order to achieve the above object, the photosensitive material drum of the invention comprises a drum body for forming an electrostatic latent image, and a flange member attached to an end portion of the drum body, wherein the flange member includes an annular protuberance covering an end surface of the drum body and a drum portion arranged neighboring the annular protuberance and inserted in the inner peripheral portion of the drum body, the annular protuberance forming notches for exposing the end surface of the drum body, and the drum portion forming protruded portions at positions corresponding to the notches so as to come in contact with the inner peripheral surface of the drum body.

In the photosensitive material drum, recessed portions can be formed between the ends of the protruded portions and the annular protuberance so as to extend toward the annular protuberance from the ends of the protruded portions.

In the photosensitive material drum, an earth plate that comes in contact with the inner peripheral surface of the drum body to earth the drum body, can be mounted on a bearing of a shaft that supports the drum body so as to rotate.

In the photosensitive material drum, the drum portion of the flange member forms recessed portions maintaining a gap to the inner peripheral surface of the drum body, the recessed portions and the protruded portions being alternately formed in the direction of inner peripheral surface of the drum body.

In the photosensitive material drum, further, an adhesive is applied onto the inner peripheral surface of the drum body opposed to the recessed portions.

Further, the photosensitive material drum may be equipped with a charging unit and a cleaning unit. The photosensitive material drum can be used for an image-forming unit equipped with a charging unit, a cleaning unit and a developing unit. Further, the photosensitive material drum can be used for an image-forming machine equipped with a charging unit, a cleaning unit, a developing unit, a paper-feeding unit, a transfer unit and a fixing unit.

DETAILED DESCRIPTION OF THE PREFERRED EMBODIMENTS

A paper-feeding device and an image-forming machine equipped with the paper-feeding device according to an embodiment of the invention will now be described with reference to the drawings. In this specification, the direction indicated by an arrow F in FIG. 1 is regarded to be the front side of the machine.

Figure 1:
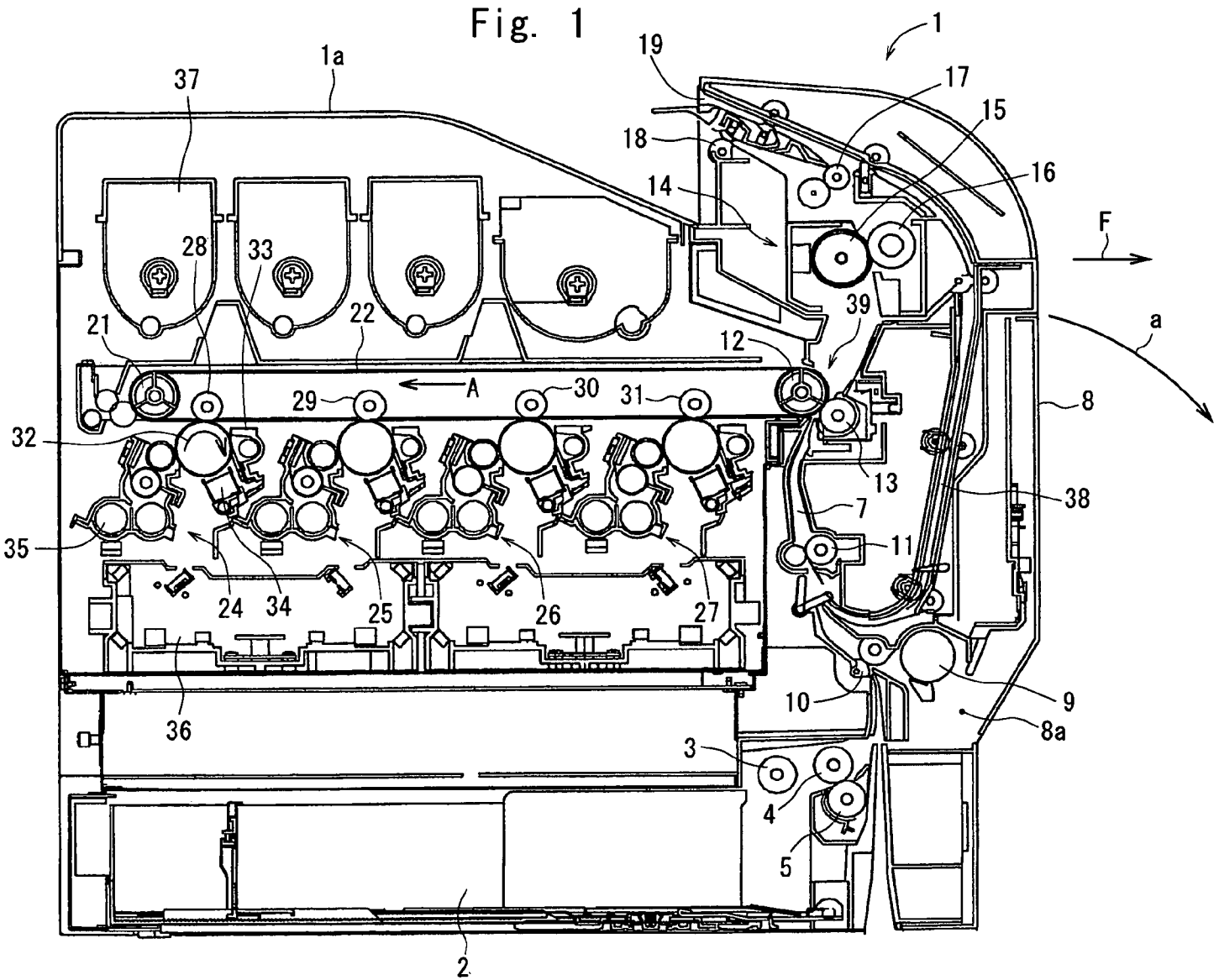
FIG. 1 is a side view schematically illustrating an image-forming machine equipped with a photosensitive material drum according to an embodiment of the present invention.

The image-forming machine 1 which is a printer shown in FIG. 1 is equipped with a paper feed cassette 2 which is a paper-feeding unit on the lower side of the machine body la to contain sheets which are printing media. On the side of discharging the sheets of the paper-feed cassette 2, there are provided a pickup roller 3 for drawing the sheet from the paper-feed cassette 2, and a pair of paper-feed roller 4 and a separator rotor 5 on the upstream side thereof. On the front surface of the machine body 1*a*, a hand-feed tray 8 can be opened in a direction indicated by an arrow (a) with a rotary shaft 8a as an axis. A paper-feed rotor 9 is disposed on the lower end side of the hand-feed tray 8. The sheets set on the hand-operated tray 8 can be transferred onto a conveyer passage 7 on the downstream side due to the rotation of the paper-feed roller 9.

The structure of the image-forming machine 1 will now be briefly described along the flow of the sheet. The conveyer passage 7 is formed on the downstream of the paper-feed rollers 4 and 9. The conveyer passage 7 includes a pair of first feed rollers 10, a pair of resist rollers 11, a drive roller 12, a second transfer roller 13, a fixing roller 15 of a fixing unit 14, a pressing roller 16, a pair of second feed rollers 17 and a pair of discharge rollers 18 toward the downstream from the paper-feed roller 4. Due to these roller groups 10 to 18, the sheets pass through the conveyer passage 7 and are discharged from a discharge port 19.

For the drive roller 12 that forms a pair with the secondary transfer roller 13, a driven roller 21 is disposed being separated away from the drive roller 12 in the horizontal direction. A transfer belt 22 is arranged around the drive roller 12 and the driven roller 21. Primary transfer rollers 28 to 31 are disposed maintaining a distance on the inner side of the transfer belt 22, and image-forming units 24 to 27 are disposed on the lower side of the transfer belt 22 being corresponded to the primary transfer rollers 28 to 31.

These image-forming units 24 to 27 are substantially the same, and only a difference is in the colors of inks fed at the time of printing. That is, the process units of yellow (Y), magenta (M), cyan (C) and black (K) are provided in this order from the upstream side along the direction (counter-clockwise direction) A in which the transfer belt 22 is traveling. The process units (Y, M, C, K) are basically constituted in the same manner but have a difference in the toner colors only. Therefore, described below in detail is the image-forming unit 24 of yellow (Y) color positioned on the upstream side in the direction in which the transfer belt travels. The image-forming units 25 to 27 of other toner colors have no reference numeral for simplifying the drawing and are not described.

The image-forming unit 24 includes drum units 32 to 34 and a developer 35, the drum units 32 to 34 being a photosensitive material drum 32, a cleaning unit 33 and a charger 34 which is a charging unit. Among them, the photosensitive material drum 32 rotates clockwise and is surrounded by the cleaning unit 33, charger 34 and developer 35 in this order in the direction in which the photosensitive material drum 32 rotates. The charger 34 has a function for uniformly charging the outer peripheral surface of the photosensitive material drum 32 to a predetermined surface potential. The surface region between the charger 34 and the developer 35 is a region irradiated with a light beam from an exposure unit 36. The photosensitive material drum 32 is exposed to the light beam to form an electrostatic latent image corresponding to the image signals on the photosensitive material drum 32.

The thus formed electrostatic latent image is visualized with a toner fed to the developing unit 35 via a toner cartridge 37, and is transferred onto the transfer belt 22 by the primary transfer roller 28. The same processing is conducted through the image-forming units 25 to 27 on the downstream, too, and the toner image transferred onto the transfer belt 22 is transferred through the transfer unit 39 onto the sheet as the transfer belt 22 is press-contacted thereto by the secondary transfer roller 13.

The toner image which is transferred onto the sheet but which has not been fixed yet, is fixed to the sheet due to the heat of the fixing roller 15 and being press-contacted by the pressing roller 16 as the sheet passes through the fixing roller 15 in the fixing unit 14. The sheet is, then, discharged through a discharge port 19. On the other hand, the toner remaining on the photosensitive material drum 32 is removed by the cleaning unit 33.

A conveyer passage of the hand-feed tray 8 arranged along the inside of the machine body la is an inverted conveyer passage 38 for both-surface printing.

Next, the photosensitive material drum 32 of the image-forming unit 24 in the image-forming machine 1 will be described in detail with reference to the drawings.

Figure 2:
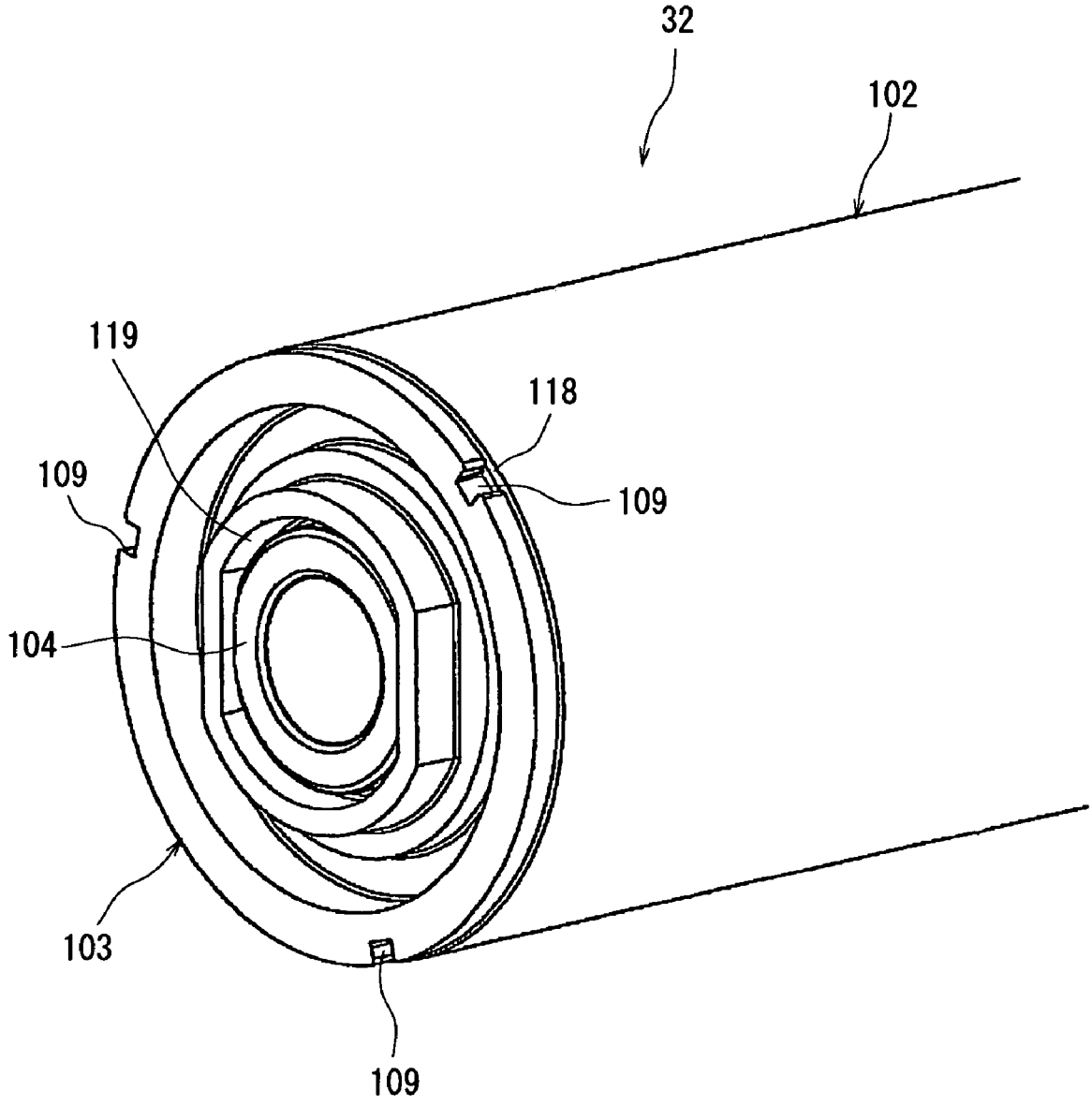
FIG. 2 is a perspective view of an end portion of the photosensitive material drum according to the embodiment of the present invention.
Figure 3:
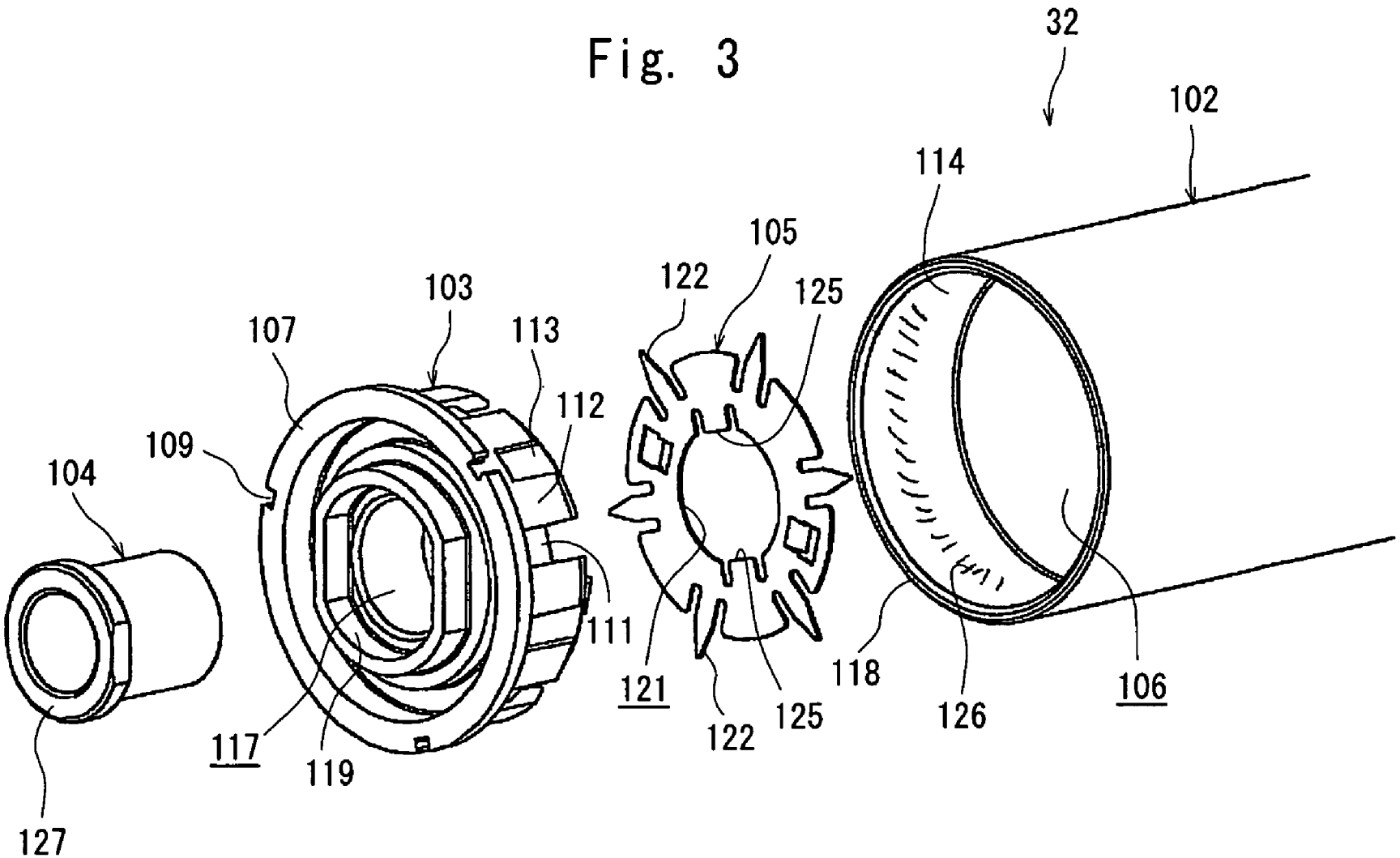
FIG. 3 is a disassembled perspective view of the photosensitive material drum of FIG. 2.
Figure 4:
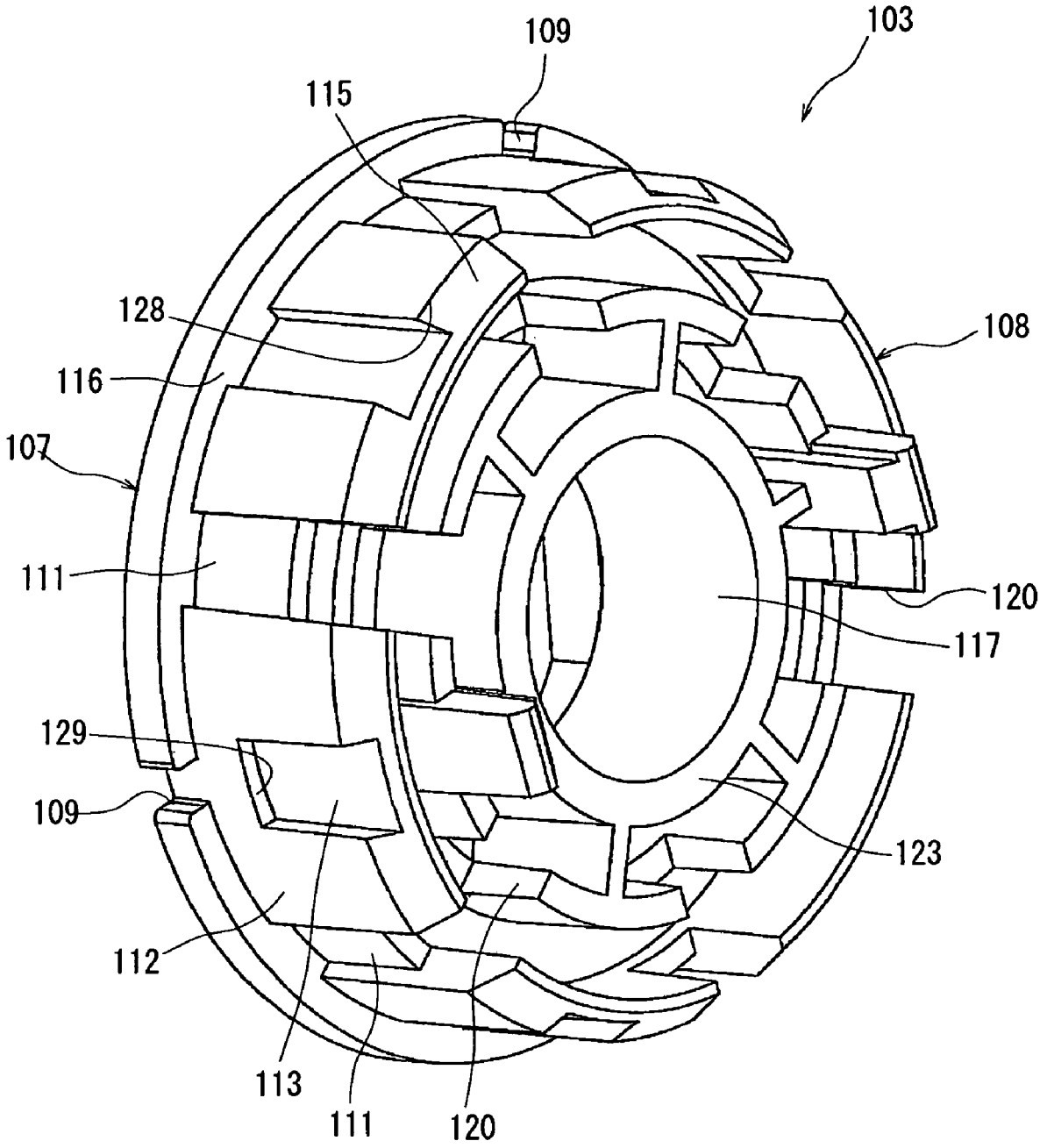
FIG. 4 is a perspective view of a flange portion of the photosensitive material drum of FIG. 2.
Figure 5:
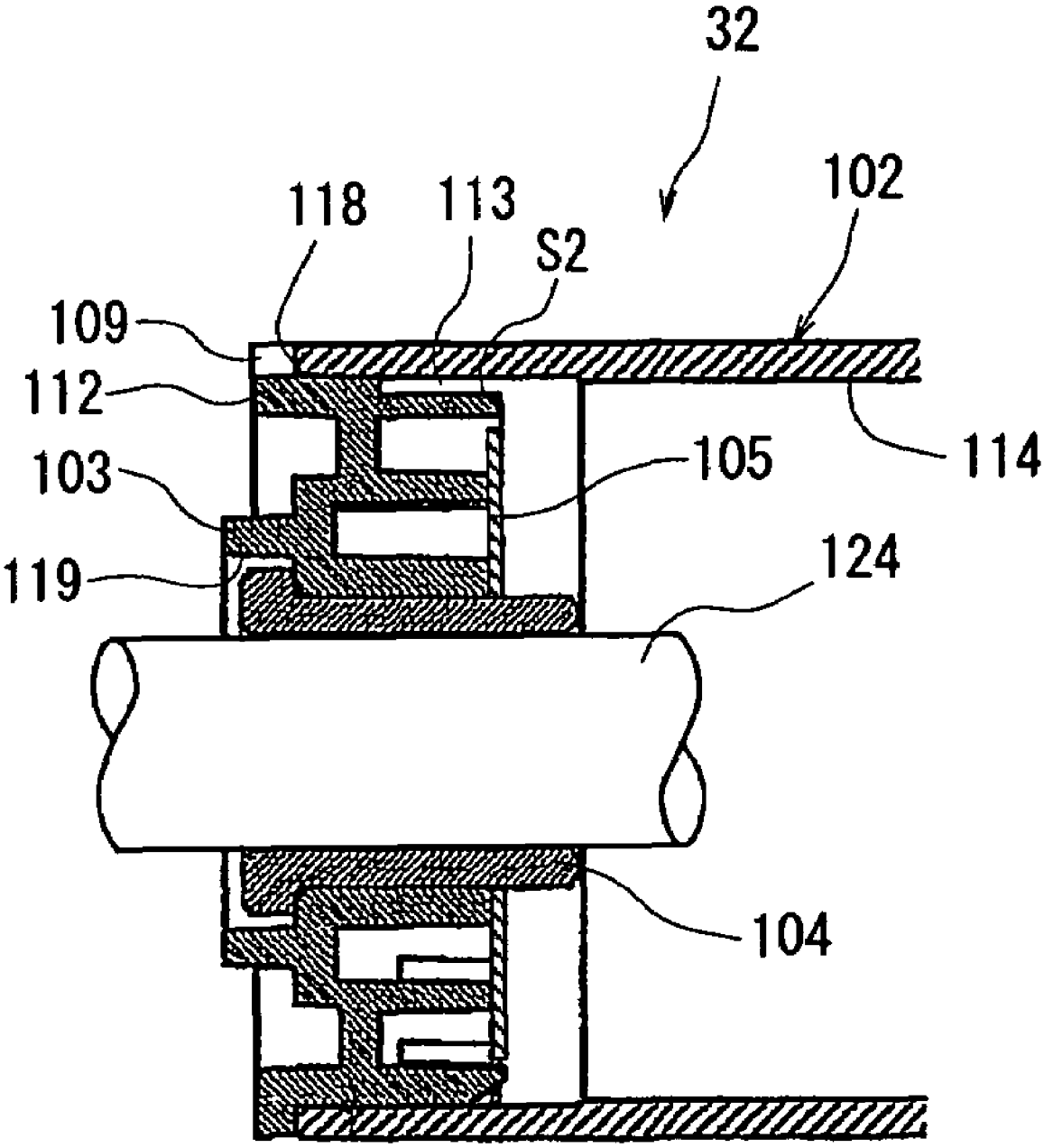
FIG. 5 is a sectional view of a portion of the flange member of the photosensitive material drum of FIG. 2 forming notches in an annular protuberance, i.e., a portion of the flange member having protruded portions.
Figure 6:
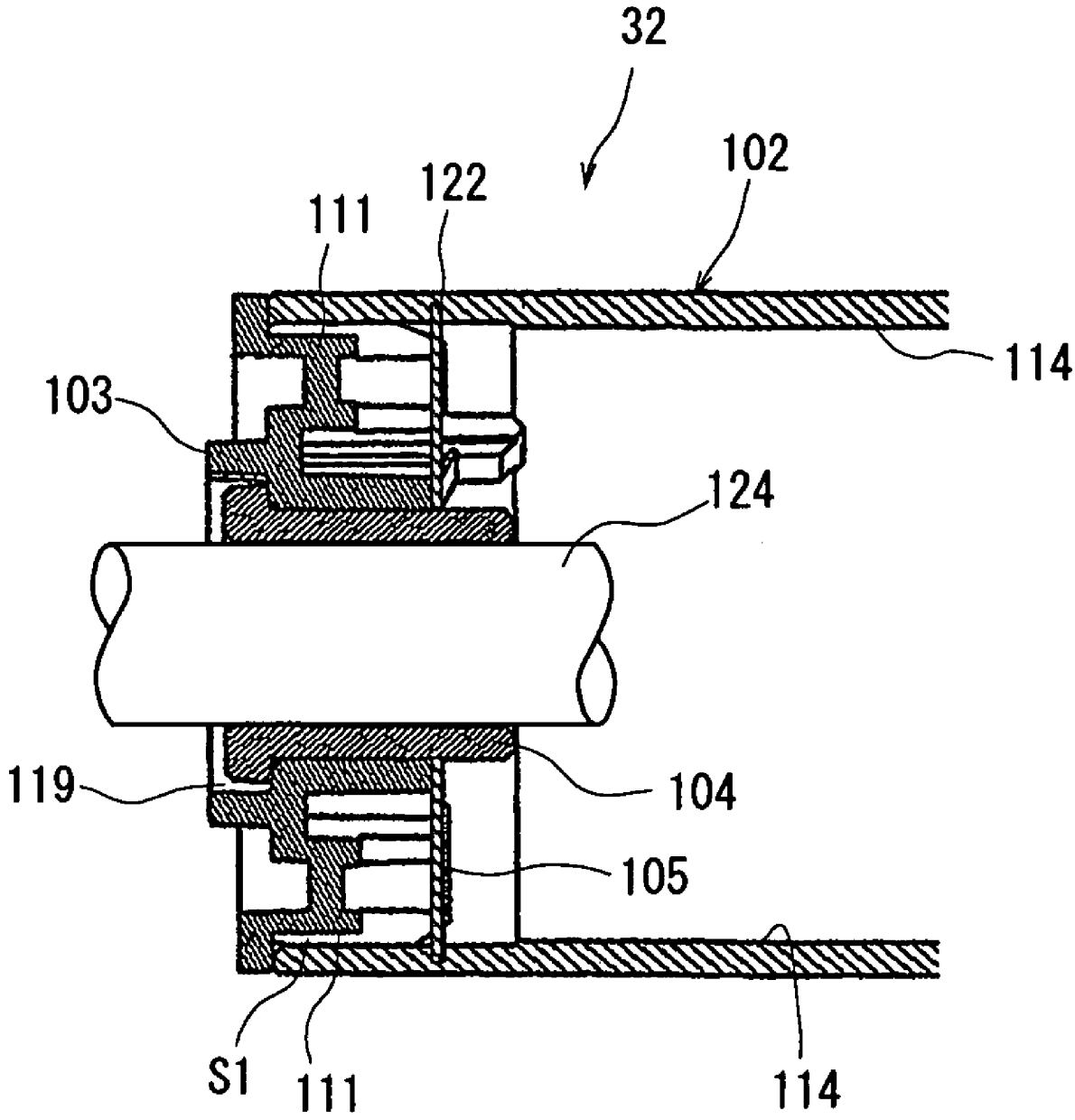
FIG. 6 is a sectional view of a portion of the flange member of the photosensitive material drum of FIG. 2 forming no notch in the annular protuberance, i.e., a portion of the flange member having recessed portions.

FIG. 2 is a perspective view of an end portion of the photosensitive material drum according to the embodiment of the present invention, FIG. 3 is a disassembled perspective view of the photosensitive material drum of FIG. 2, FIG. 4 is a perspective view of a flange portion of the photosensitive material drum of FIG. 2, FIG. 5 is a sectional view of a portion of the flange member of the photosensitive material drum of FIG. 2 forming notches in an annular protuberance, i.e., a portion of the flange member having protruded portions, and FIG. 6 is a sectional view of a portion of the flange member of the photosensitive material drum of FIG. 2 forming no notch in the annular protuberance, i.e., a portion of the flange member having recessed portions.

Referring to FIGS. 2 and 3, the photosensitive material drum 32 includes a cylindrical drum body (drum blank tube) 102, an annular flange member 103 disposed in a side portion of the drum boy 102, a bearing 104 fitted to the inner peripheral portion of the flange member 103 and an earth plate 105.

The drum body 102 has a silicon layer which is an amorphous silicon-type photosensitive material deposited on the outer peripheral surface over the full length thereof due to the method of production thereof. However, no silicon layer is deposited on an end surface of the drum body 102; i.e., an end of the drum body 102 is opened, and a plastic flange member 103 is forcibly inserted in an opening 106 thereof.

Referring to FIG. 3, the bearing 104 of the photosensitive material drum 32 is supported by an inner hole 117 of the flange member 103 and is fitted into a hole 121 of the earth plate 105. A drum shaft 124 (see FIGS. 5 and 6) of a circular shape in cross section is fitted into the bearing 104 so as to rotatably support the photosensitive material drum 32. An elliptic portion 127 having an elliptic outer shape is formed at an end of the bearing 104, a holding portion 119 is formed on the outer surface side of the flange member 103 to hold the elliptic portion 127 of the bearing 104 of an elliptic shape, and the bearing 104 is fixed to the flange member 103 integrally therewith. In a state where the bearing 104 is incorporated in the photosensitive material drum 32, the drum body 102, flange member 103, earth plate 105 and bearing 104 rotate integrally together with the drum shaft 124 (see FIGS. 5 and 6) as a center of rotation. The bearing 104 is made of an electrically conducting member and attains an electric contact as contact pieces 125 of the shape of tongue pieces of the earth plate 105 come into strong contact with the outer peripheral surface of the bearing 104.

The earth plate 105 is in the form of a leaf spring to produce resiliency and has, in this embodiment, six pawls 122 outwardly extending in the radial directions, the length (in the radial direction) from the center of the earth plate 105 to the ends of the pawls 122 being slightly longer than the radius of the inner peripheral surface 114 of the drum body 102. The pawls 122 are inserted in the slits 120 (see FIG. 4) of the flange member 103. The hole 121 is formed in the central portion of the earth plate 105.

Referring to FIGS. 3 and 4, the flange member 103 has an annular protuberance 107 arranged on the outer side of the photosensitive material drum 32 and an insertion drum portion 108. The annular protuberance 107 is formed at an end of the flange member 103 so as to protrude outward in the radial direction of the flange member 103, and its outer diameter is nearly in agreement with the outer diameter of the drum body 102. The height of the annular protuberance 107 is nearly in agreement with the thickness of the cylinder of the drum body 102, and a contact surface 116 is formed on the side (longitudinal) surface of the annular protuberance 107 on the side of the insertion drum portion 108 to come in contact with the end surface 118 of the drum body 102. The annular protuberance 107 is forming notches 109 at three places maintaining a distance of 120 degrees in the circumferential direction, the notches 109 penetrating through the annular protuberance 107 in the axial direction of the drum body 102.

The insertion drum portion 108 of the flange member 103 is forming recessed portions 111 and protruded portions 112 in the outer peripheral portion thereof, the recessed portions 111 and the protruded portions 112 being alternately arranged in the circumferential direction of the insertion drum portion 108. The length (outer diameter) from the surface of the protruded portion 112 to the surface of the protruded portion 112 at opposing positions in the radial direction of the flange member 103 is slightly greater than the inner diameter of the drum body 102. In a state where the flange member 103 is forcibly inserted in the drum body 102, a gap S1 (see FIG. 6) is formed between the recessed portions 111 and the inner peripheral surface 114 of the drum body 102. Inclined surfaces 115 becoming slim toward the ends are formed at the ends of protruded portions 112 of the flange member 103 on the other end side (inner side of the drum body 102), the ends being directed inward in the radial direction of the flange member 103.

Among the plurality of protruded portions 112, the protruded portions 112 disposed neighboring the positions where the notches 109 are formed are forming recessed portions 113 at positions maintaining a distance from the annular protuberance 107. At positions where the notches 109 are formed, the recessed portions 113 are arranged on the extensions which are in parallel with the axis of the drum body 102, are so formed as to extend from the inner portions of the protruded portions 112 toward the inner side of the drum body 102 in the axial direction. In a state where the flange member 103 is incorporated in the drum body 102, a gap S2 (see FIG. 5) is formed between the bottom surfaces of the recessed portions 113 and the inner peripheral surface 114 of the drum body 102. The above three notches 109 have bottom surfaces arranged substantially in flush with the surfaces of the protruded portions 112, and no notch 109 is formed at portions corresponding to the recessed portions 111.

A plurality of (six in this embodiment) slits 120 are formed in the insertion drum portion 108 of the flange member 103 on the side of the other end extending in the axial direction of the flange member 103. A holding surface 123 of nearly a circular shape for arranging the earth plate 105 is formed on the insides of the recessed and protruded portions 111, 112 of the insertion drum portion 108.

The inner hole 117 is formed in the central portion of the flange member 103, the bearing 104 is fitted into the inner hole 117 as shown in FIGS. 5 and 6, and the photosensitive material drum 32 is supported by the drum shaft 124 via the bearing 104.

In assembling the members of the photosensitive material drum 32 as shown in FIG. 3, first, the bearing 104 is inserted in the inner hole 117 of the flange member 103 and, next, the earth plate 105 is fitted to the flange member 103 and to the bearing 104. During the assembling, contact pieces 125 of the earth plate 105 are so anchored as to bite the outer peripheral surface of the bearing 104. Therefore, the flange member 103, bearing 104 and earth plate 105 are integrally assembled together. A thermoplastic adhesive 126 is applied in advance onto the inner peripheral surface 114 of the drum body 102 on the side of an end portion thereof, and the flange member 103 in which the bearing 104 and the earth plate 105 are incorporated is lightly inserted in the drum body 102 so will not to cause deformation.

Referring to FIGS. 3 and 4, in forcibly inserting the flange member 103 in the drum body 102, the insertion drum portion 108 of the flange member 103 is inserted in the inner peripheral surface 114 of the opening 106 of the drum body 102 shown in FIG. 3 from the side of the inclined surfaces 115 shown in FIG. 4. The inclined surfaces 115 facilitate the insertion of the flange member 103 in the drum body 102. The plurality of slits 120 in the flange member 103 extending in the axial direction produce resiliency in the radial direction of the drum body 102, facilitating the insertion of the flange member 103, enabling the flange member 103 to be easily inserted in the drum body 102, and preventing the application of internal pressure to the drum body 102.

In forcibly inserting the flange member 103, edges 128 have been formed on the protruded portions 112 of the flange member 103 on the side of the inclined surfaces 115, and work to push the adhesive 126 inward of the drum body 102 or cause the adhesive 126 to flow into the recessed portions 111 on both sides thereof or into the recessed portions 113. The corners of the recessed portions 113 play the role of weirs 129, and the adhesive agent 126 can be stored in the weirs 129. The surfaces of the protruded portions 112 come into close contact with the inner peripheral surface 114 of the drum body 102. Therefore, the adhesive 126 in the recessed portions 111 do not enter into between the contacting surfaces of the protruded portions 112 and the inner peripheral surface 114.

The notches 109 are formed in the flange member 103 at positions where the protruded portions 112 are present. Therefore, no adhesive 126 flows out through the notches 109. When the flange member 103 is incorporated in the drum body 102, the contact surface 116 of the annular protuberance 107 comes in contact with the end surface 118 of the drum body 102, and the end surface 118 of the drum body 102 is locally exposed to the outer side at portions where the notches 109 are formed.

As the adhesive 126 applied onto the inner peripheral surface of the drum body 102 solidifies, the motion of the flange member 103 is limited by the thickness of the adhesive agent 126, and the drum body 102 is prevented from turning. In the weirs 129 of recessed portions 113 into where the adhesive 126 flows, in particular, the solidified adhesive layer of an increased thickness contributes to increasing the effect for preventing the turn.

Figure 10:
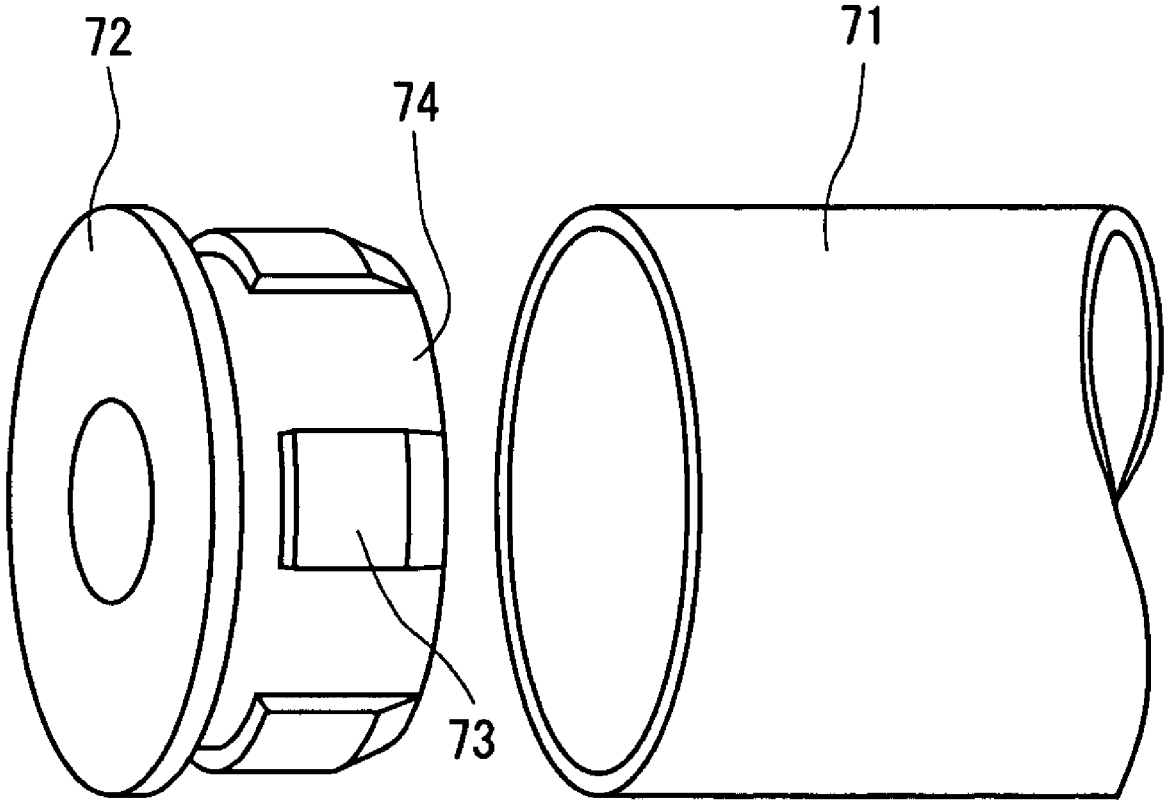
FIG. 10 is a perspective view showing a conventional manner of fixing a flange member to a photosensitive material drum.

According to this embodiment as described above, even when the adhesive 126 is applied onto the whole inner peripheral surface 114 of the drum body 102 in the circumferential direction thereof, the adhesive 126 does not flow out through the notches 109 and no strict control is required concerning the positions for applying the adhesive or the amount of applying the adhesive that were needed in the prior art shown in FIG. 10 as described above.

Referring to FIGS. 5 and 6, the earth plate 105 has the pawls 122 of a length in the radial direction which is slightly larger than the radius of the inner peripheral surface of the drum body 102, and attains the conduction to the drum body 102 as the pawls 122 come in contact with the inner peripheral surface 114 of the drum body 102.

That is, the conduction test of the photosensitive material drum 32 is carried out by bringing a detection pin such as of a tester that is not shown into contact with the end surface 118 of the drum body 102 at the position of the notch 109 and by bringing the other detection pin into contact with, for example, the bearing 104 or the drum shaft 124. When the conduction is perfect, the conduction is in order of the drum body 102, earth plate 105 and bearing 104. The size of the notches 109 may be such that the detection pin can be inserted therein. Further, though the surfaces of the notches 109 and of the protruded portions 112 were in flush, they do not have to be in flush.

Referring to FIG. 2, the number of notches 109 of the flange 108 may be so selected that any notch 109 can be viewed at any rotational angle at the time of detection by viewing the end of the drum body 102. Therefore, when the end of the photosensitive material drum 32 cannot be easily seen, the notches 109 may be formed in an increased number. When the end thereof can be easily seen, on the other hand, the notches 109 may be formed in a decreased number.

In this embodiment, only one end side of the photosensitive material drum 32 was described, and the earth plate 105 provided on one end side only suffices the need. Depending upon the circumstances, however, the earth plates may be disposed at both end portions of the photosensitive material drum 32, and the notches 109 for detecting the earthing may be formed in both end portions of the photosensitive material drum 32, so that the earthing can be detected from either direction.

Though an embodiment of the invention was described above, it should be noted that the invention can be variously modified or altered relying upon the technical idea of the present invention, as a matter of course.

Figure 7:
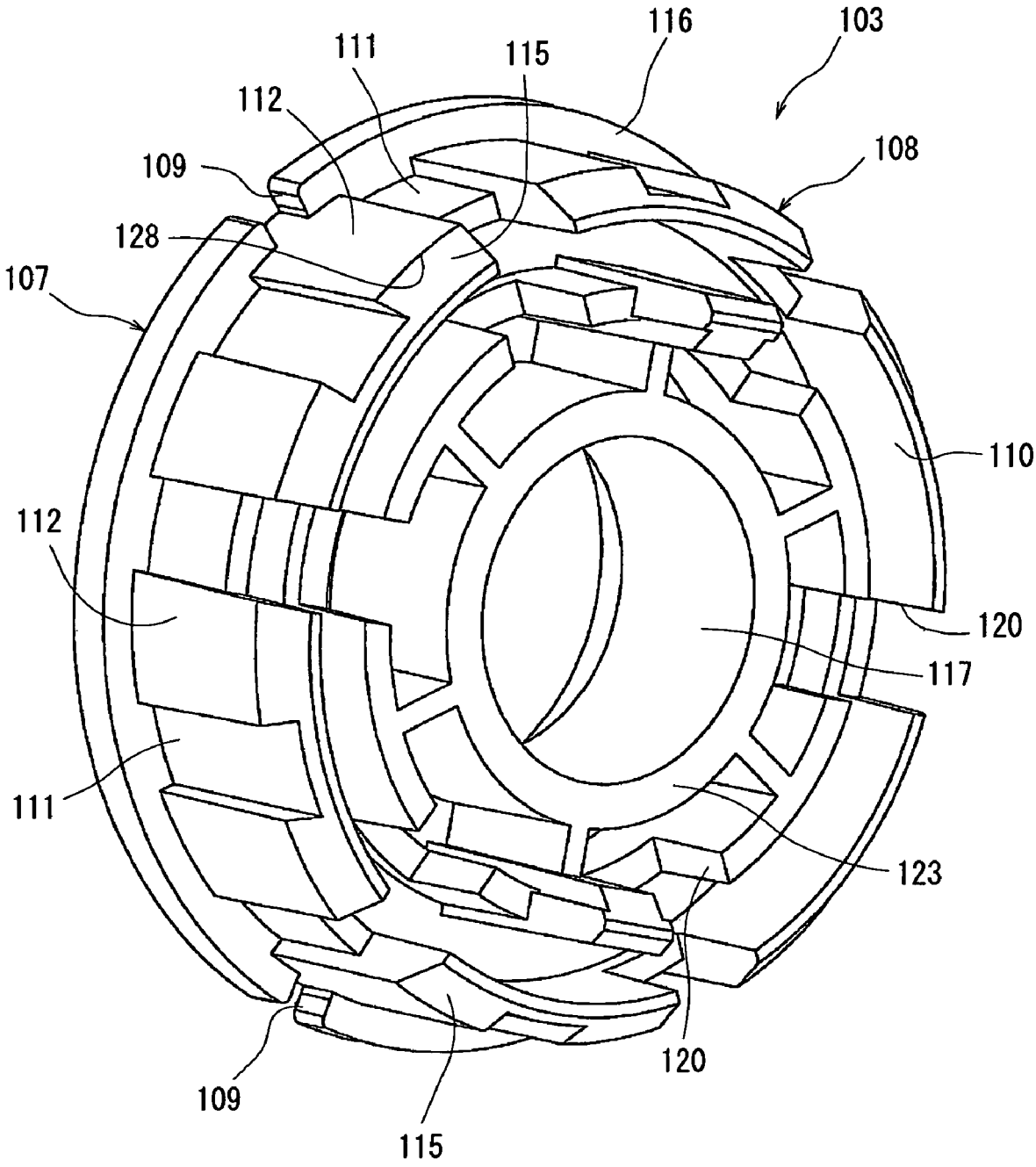
FIG. 7 is a perspective view of the flange member of the photosensitive material drum according to a modified embodiment.
Figure 8:
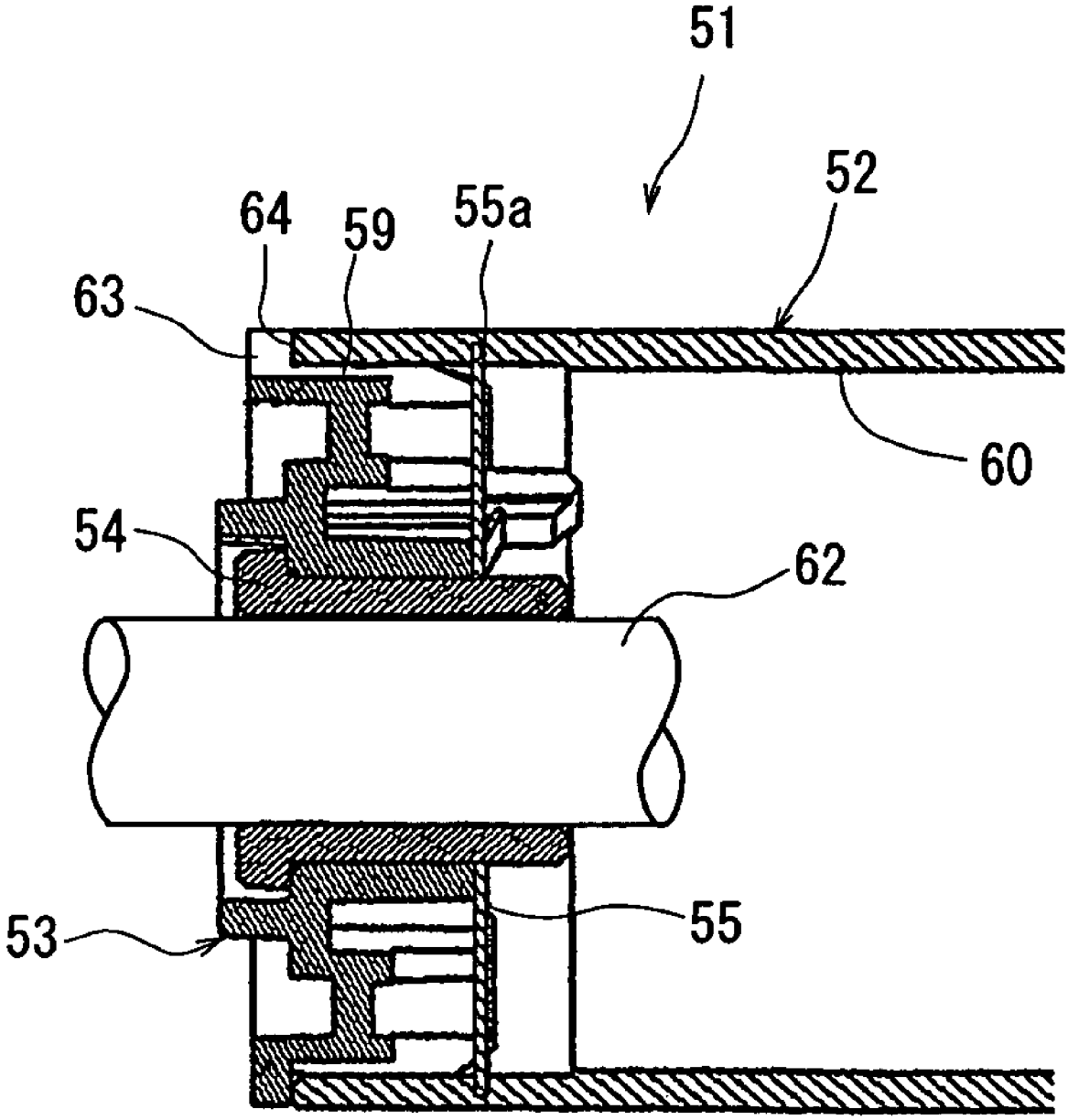
FIG. 8 is a sectional view of an end portion of a photosensitive material drum of the related art, i.e., a portion of the flange member forming notches in the annular protuberance.
Figure 9:
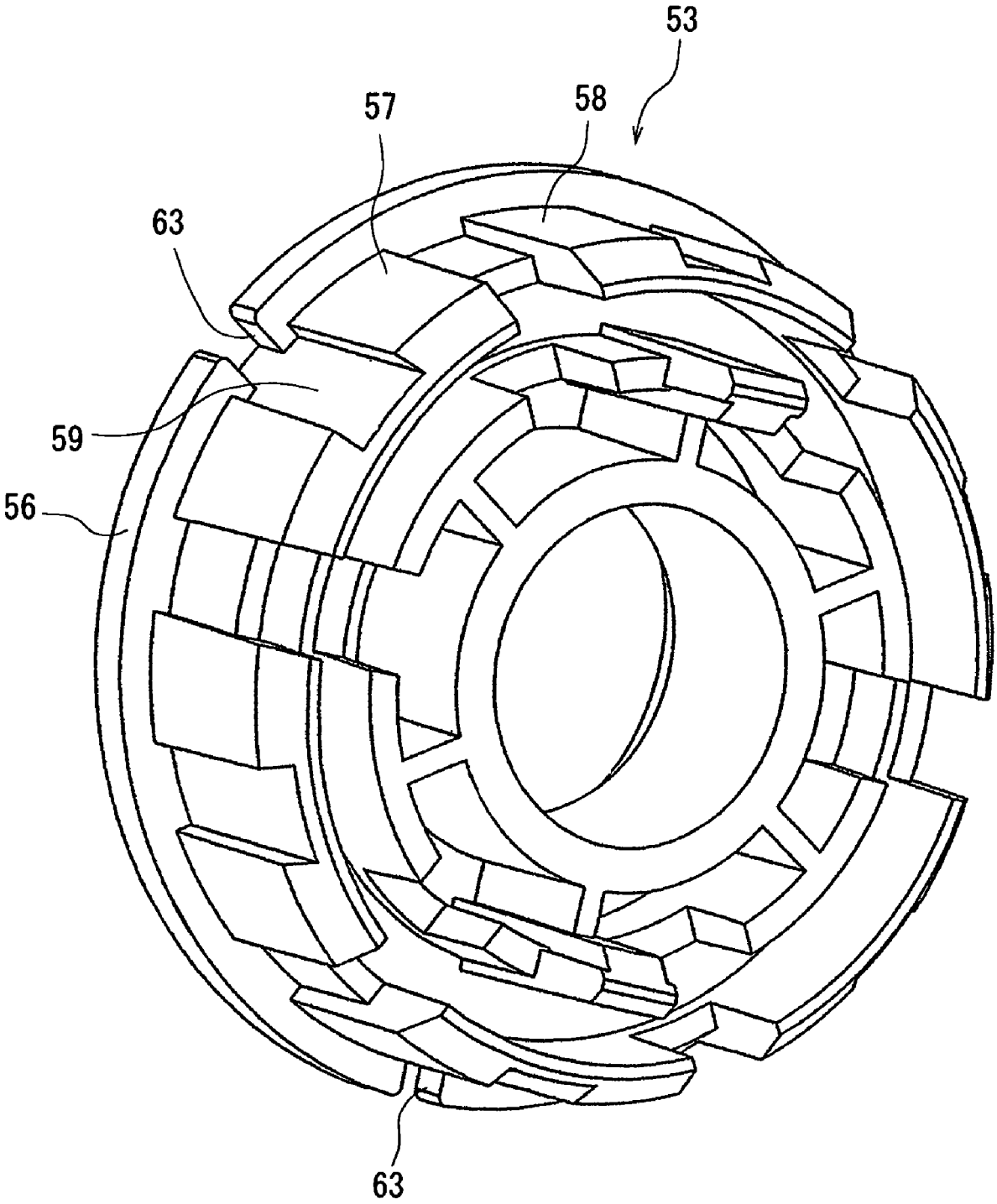
FIG. 9 is a perspective view of the flange member of the photosensitive material drum of FIG. 8.

FIG. 7 illustrates a modified embodiment of the flange member 103 and in which the same portions as those of the above embodiment are denoted by the same reference numerals. In the flange member 103 of the above embodiment, recessed portions 113 were formed in the protruded portions 112. However, the recessed portions 113 may not be formed as in this modified embodiment to simplify the structure. Further, though the recessed portions 113 were formed in a rectangular shape, they may be formed in a U-shape or in a trapezoidal shape.

Further, the above embodiment has dealt with the amorphous silicon (A-Si) type drum body 52. However, the present invention can be applied to any drum body (e.g., OPC drum) having a photosensitive layer deposited on the whole peripheral surface of the drum body.

As described above, the photosensitive material drum of the invention comprises a drum body for forming an electrostatic latent image, and a flange member attached to an end portion of the drum body, wherein the flange member includes an annular protuberance covering an end surface of the drum body and a drum portion arranged neighboring the annular protuberance and inserted in the inner peripheral portion of the drum body, the annular protuberance forming notches for exposing the end surface of the drum body, the drum portion forming protruded portions so as to come in contact with the inner peripheral surface of the drum body, and the notches being formed at positions neighboring the protruded portions. This prevents the adhesive from leaking to the outer side of the drum body through the recessed portions and makes it possible to omit strict control of a step of handling the adhesive.

In the present invention, recessed portions are formed in the protruded portions extending from the inner portions of the protruded potions toward the opposite side of the annular protuberance up to the ends of the protruded portions. Therefore, the adhesive is applied even onto the inner peripheral surface of the drum body corresponding to the recessed portions increasing the interference portions between the adhesive and the protruded portions, and further increasing the fixing force between the photosensitive material drum and the flange member.

The invention claimed is:

1. A photosensitive material drum comprising:

a drum body for forming an electrostatic latent image, and a flange member attached by an adhesive to an end portion of said drum body, wherein said flange member includes an annular, circular-shaped protuberance covering an end surface of said drum body, and a drum portion arranged neighboring said annular, circular-shaped protuberance and inserted in an inner peripheral portion of said drum body, said annular, circular-shaped protuberance having notches for exposing said end surface of said drum body, and said drum portion having protruded portions flush with bottom surfaces of the notches, said protruded portions contacting with inner peripheral surfaces of said inner peripheral portion of said drum body.

2. The photosensitive material drum according to claim 1, wherein recessed portions are formed between the ends of said protruded portions and said annular protuberance so as to extend toward said annular protuberance from the ends of said protruded portions.

3. The photosensitive material drum according to claim 1, wherein an earth plate that comes in contact with the inner peripheral surface of said drum body to earth said drum body, is mounted on a bearing of a shaft that supports said drum body so as to rotate.

4. The photosensitive material drum according to claim 1, wherein the drum portion of said flange member forms recessed portions maintaining a gap to the inner peripheral surface of said drum body, said recessed portions and said protruded portions being alternately formed in the direction of inner peripheral surface of said drum body.

5. The photosensitive material drum according to claim 1, wherein the adhesive is applied onto the inner peripheral surface of said drum body opposed to said recessed portions.

6. A drum unit including a photosensitive material drum, a charging unit and a cleaning unit, said photosensitive material drum being constituted by the photosensitive material drum of claim 1.

7. An image-forming unit including a photosensitive material drum, a charging unit and a cleaning unit, said photosensitive material drum being constituted by the photosensitive material drum of claim 1.

8. An image-forming machine including a photosensitive material drum, a charging unit, a cleaning unit, a developing unit, a paper-feeding unit, a transfer unit and a fixing unit, said photosensitive material drum being constituted by the photosensitive material drum of claim 1.

* * * * *